US005210993A

United States Patent [19]

van Boxtel

[11] Patent Number: 5,210,993

[45] Date of Patent: May 18, 1993

[54] METHOD AND APPARATUS TO IMPLEMENT DOUBLE OPPOSED CONTAINERS FED AS A CONTINUOUS BAND TO FILLING STATIONS AND TO BE SEALED BY WELDING, AS WELL AS PACKAGES THUS OBTAINED

[75] Inventor: G. J. M. van Boxtel, Tilburg, Netherlands

[73] Assignee: Crescent Holding H.V., Netherlands

[21] Appl. No.: 797,310

[22] Filed: Nov. 25, 1991

[30] Foreign Application Priority Data

Nov. 28, 1990 [EP] European Pat. Off. ..... 90203147

[51] Int. Cl.[5] ..... B65B 43/04

[52] U.S. Cl. ..... 53/455; 53/459; 53/568; 493/198

[58] Field of Search ..... 53/562, 568, 567, 455, 53/456, 459, 468, 469; 493/198, 196, 195, 194, 193, 197

[56] References Cited

U.S. PATENT DOCUMENTS

| | | | |
|---|---|---|---|
| 2,671,587 | 3/1954 | Vogt | 226/51 |
| 2,671,588 | 3/1954 | Vogt | 226/51 |
| 2,884,988 | 5/1959 | D'Angelo | 53/455 X |
| 3,033,257 | 5/1962 | Weber | 53/455 X |
| 3,045,891 | 7/1962 | Alvarez | 229/69 |
| 3,194,124 | 7/1965 | Warp . | |
| 3,393,493 | 7/1968 | Membrino . | |
| 3,599,388 | 8/1971 | Feingold | 53/455 |
| 3,791,267 | 2/1974 | Brooks . | |
| 3,791,573 | 2/1974 | Titchenal et al. | 229/69 |
| 4,216,639 | 8/1980 | Gautier | 53/455 X |
| 4,694,959 | 9/1987 | Ausnit | 53/430 X |

FOREIGN PATENT DOCUMENTS

| | | |
|---|---|---|
| 0334242 | 9/1989 | European Pat. Off. . |
| 2808550 | 8/1979 | Fed. Rep. of Germany . |
| 3839336 | 6/1989 | Fed. Rep. of Germany . |
| 1044871 | 11/1953 | France . |
| 1207457 | 2/1960 | France . |
| 2369162 | 5/1978 | France . |
| 7511976 | 4/1977 | Netherlands . |
| 681096 | 10/1952 | United Kingdom . |

*Primary Examiner*—James F. Coan

*Attorney, Agent, or Firm*—Ostrolenk, Faber, Gerb & Soffen

[57] ABSTRACT

A method and apparatus for producing and filling a plurality of pairs of containers from a flexible material. The lateral edges of a band of the flexible material are folded over, with a heat-sealable material forming an internal surface of the folded portions. Each folded portion has a transversal width equal to at least a height of the individual container to be produced. A series of heat seals are formed transversely along each folded portion at longitudinal intervals. Each of the longitudinal intervals are equal to a width of the individual container to be produced. The heat seals form lateral closing ribs between adjacent pairs of containers and terminate a short distance from the lateral edge of the folded portions. A center strip is maintained between the containers comprising each pair, with the heat seals extending from the sides of each of the folded portions and toward the center strip. The folded portions are cut transversely along a midline of the heat seals from the side toward the center strip, without cutting the center strip. Adjacent containers are detached from each other along the cut mid-line, wherein each of the plurality of pairs of containers remain connected along the center strip and at a point adjacent to the sides of the folded portions.

15 Claims, 3 Drawing Sheets

FIG. 6.
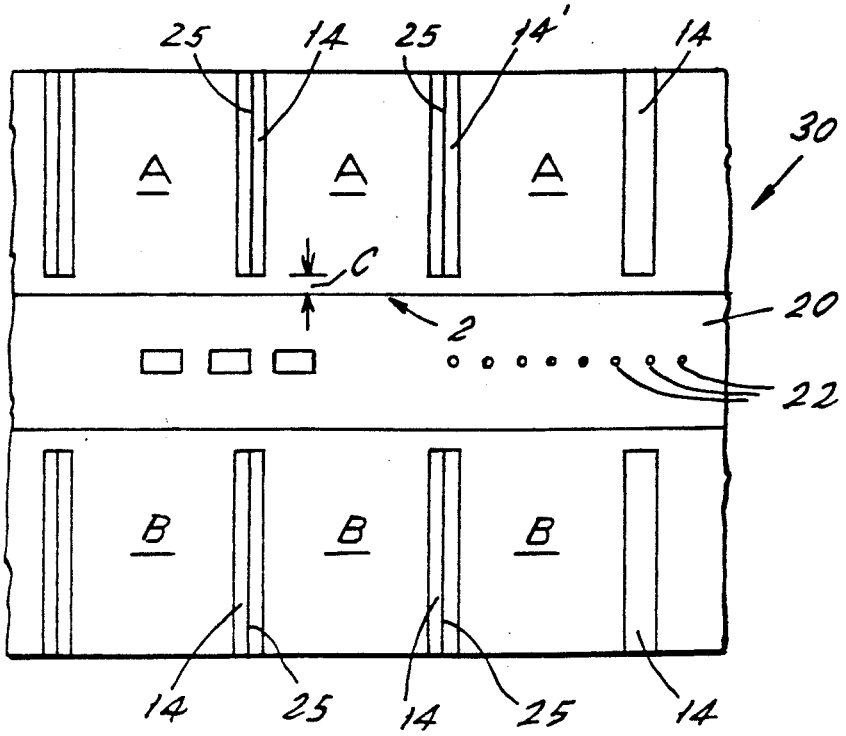
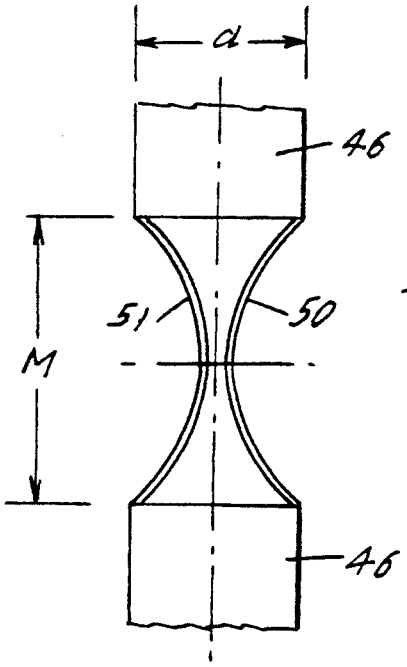
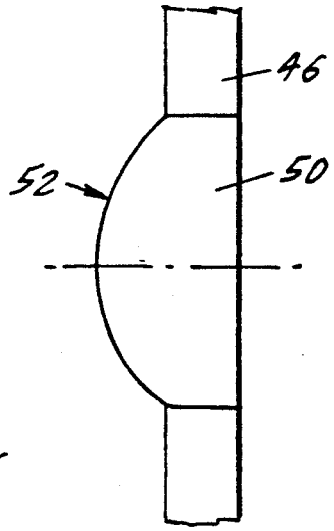
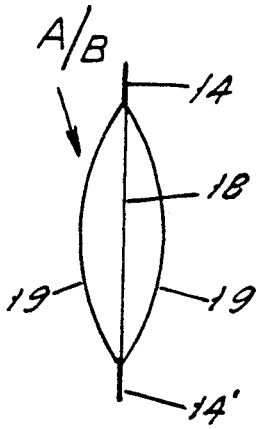
FIG. 8. FIG. 9 FIG. 3.

METHOD AND APPARATUS TO IMPLEMENT DOUBLE OPPOSED CONTAINERS FED AS A CONTINUOUS BAND TO FILLING STATIONS AND TO BE SEALED BY WELDING, AS WELL AS PACKAGES THUS OBTAINED

BACKGROUND OF THE INVENTION

1. Field of the Invention

This invention relates to a method and equipment for the production of double opposed containers to be fed in the form of a continuous band to filling stations and sealed, as well as the packages thus obtained.

2. Description of the Prior Art

In the field of packaging, especially for consumer products, the present tendency is to simplify filling operations and reduce the container size in order to achieve economic savings. The use of lightweight materials to facilitates transportation of the packages and collection of the used containers, thereby reducing disposal costs.

Presently for example, bulkier and costlier containers for liquid detergents have been replaced with small envelopes made of flexible material containing only the concentrated detergent which can be diluted at home with water. The envelopes when empty weigh just a few grams, occupy only a negligible space in the refuse bin and are easily disposable by combustion, thereby permitting recovery of energy. The envelopes also replace conveniently replace conventional rigid type packages made of glass or metal for containing liquids of various chemical and industrial nature.

If the envelopes are sterilized and prepared with an aseptic filling system, they are also suitable for long term containment and conservation of food products of various degrees of fluidity, such as milk, juices, concentrates or other alimentary pulps. In addition to the above advantages of a practical economic and sanitary nature, a better display on the shelves of supermarkets can be realized, by a package of flexible material which once filled, will draw the attention of the consumer because it can be placed providing an upright position in a better display, and a wide surface on which inscriptions can be printed.

SUMMARY OF THE INVENTION

The purpose of the invention is to establish a method for the fabrication of containers of flexible material to be used especially for products in the liquid state and compatible with automatic packaging apparatus resulting in good productivity, and being at the same time simple and economical, making the method accessible also to small packaging companies .

According to the of this invention in a first fabrication step, pairs of containers having their respective apertures set specularly face to face and connected to each other by a jointing strip, which may be eliminated after the packages are sealed so as to form a continuous band are collected either in the form of a coil or to be folded concertina wise into boxes for easy utilization by the filling facilities of packaging companies.

A particular type of ribbing for stiffening the packing can be obtained by heat sealing the sides of the bottom of the single containers during preparation of the band so as to obtain self supporting packages able to stand in an upright position on the shelves of shops and characterized also by a wide external surface on which inscriptions may be conveniently printed.

In the second fabrication step, the filling equipment which is to receive and utilize the coupled containers in semi-finished form as a product already fit for final packing, can be simplified and relatively economical affordable even by the smaller packaging companies.

For a more reliable and better utilization of the band of coupled containers and in order to improve the productivity of the filling equipment, the apparatus is provided with a device for automatic divarication of the inlet apertures of the single packages so as to facilitate the introduction of the product at the relevant point of the filling station.

The invention will now be described with reference to the annexed drawings showing the preferred embodiments, both in regard to the prefabrication of the container band and to the equipment utilizing the bands.

BRIEF DESCRIPTION OF THE DRAWINGS

FIG. 3 is a bottom view of a packaged container fitted with a bellows;

FIG. 6 is a top view of a band of container pairs, arranged on a plane;

FIG. 8 is a top view of a detail of the separating device coninciding with the filling station as shown in FIG. 7;

FIG. 9 is a side view of FIG. 8.

DETAILED DESCRIPTION OF THE INVENTION

Figure 1:
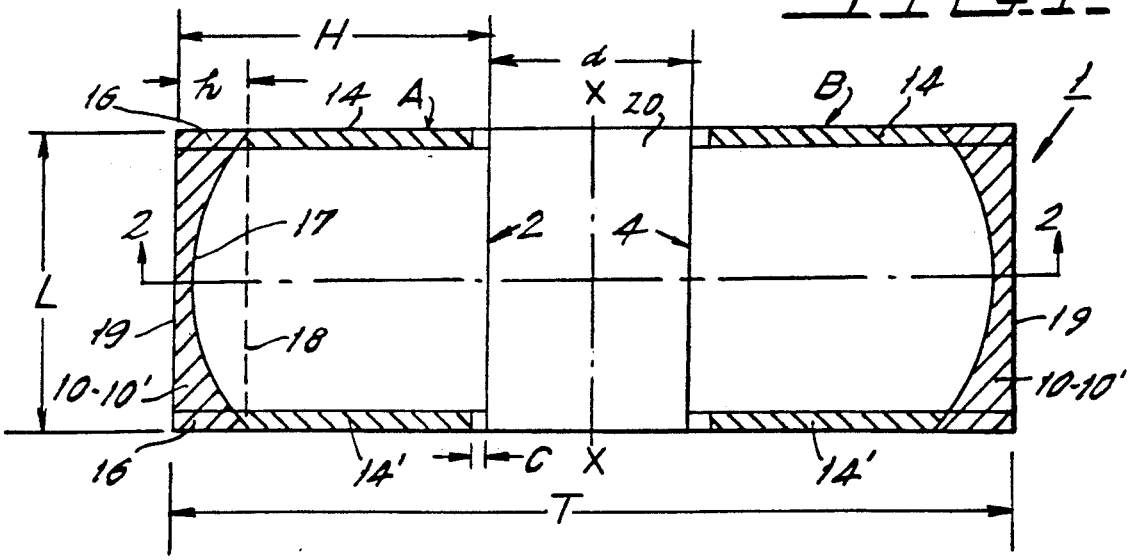
FIG. 1 is a plan view of a pair of containers with bellowed bottoms, forming an integral part of the continuous band according to the invention.
Figure 2:
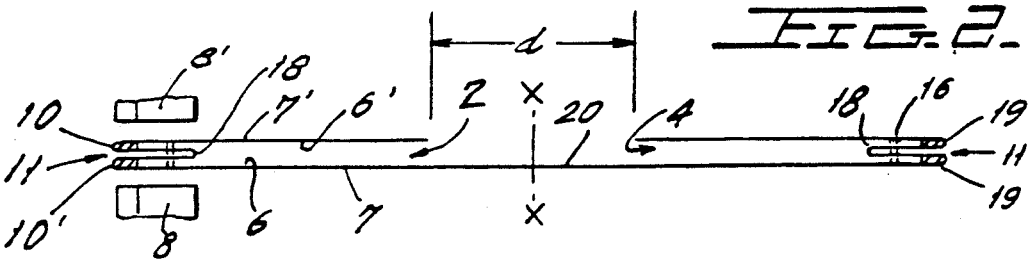
FIG. 2 is a schematic cross-sectional view of the same pair of containers shown in FIG. 1, taken along lines II—II in FIG. 1.

FIGS. 1 and 2 show a pair of containers, A and B with bellowed bottoms and respective apertures 2 and 4 opposite to each other. In the figures, T indicates the transversal dimension of a pair of containers pre-formed and laid on a plane, L the finished width of a container, H the height, d the distance between openings 2 and 4 and h the height of a double S fold of the lateral edges. The pairs of containers A and B, identified altogether by number 1, is formed, starting from a band having an original width equal to $T+2H+4H$ which is folded as shown in cross-section in FIG. 2. This figure shows, in particular a single layer package of coupled flexible material of which at least surface 6 and relative folded surface 6', both of which are internal surfaces, are heat sealable while external surface 7, 7' made of a different material can act as a reinforcement, both to improve appearance and to provide a space for markings, inscriptions etc.

Successively, heat seals 14, 14' perpendicular with respect to longitudinal axis X—X of the band, are prefomed at longitudinal intervals equal to the width of the containers to be produced, so as to form two ribs constituting the lateral sealed closures of the container. Preferably the seals extend to a distance C equal to a few millimeters below the edge of apertures 2 or 4 of the container in order to obtain less rigid lips and more easily separable flaps to improve the filling operation. In order to produce packages able to support themselves in a vertical position, the lateral ends of the folded band are pressed by suitable shaped heatable jaws 8 and 8' to provide, at the bottom of each container, the union of the opposite heat weldable surfaces 6, 6' shaping the welding in the form of an arc of a circle, as shown by the hatched surfaces 10, 10' of FIGS. 1 and 2, along an arched line 17 having the concavity facing toward the respective apertures 2 and 4. To laterally join the two edges of the bellows of each bag, at least one welding notch 16 can be formed if necessary and depending on the type of material used, on each of the two side edges of the bellows. As a result of which, the melting of the material of internal layer 6 acts as a binder for the external non heat sealable material, causing the union of the overlapped bellows edges in the lower part of the containers.

FIG. 3 is a bottom view of one of containers A or B after filling, which sets itself, due to the weight of the included product, with the bottom bellows expanded to form a supporting base. Number 19 in FIG. 3 indicates the lower edges of the bellows formed by the assembly of the coupled sheet with its internal heat sealable surface closed laterally along ribs 14, 14'. Number 17 (see also FIG. 2) indicates the arched bottom line formed in each container by the double seal 10, 10', while number 18 identifies the internal folding line of the bellows.

Before collecting a band 30 of containers thus formed (see FIG. 6), ribs 14, 14' are divided transversally with cuts 25 at their mid line without affecting the unfolded center strip cuts 25 extend only in proximity of the lateral ends of the folded band in order to detach one container from the other on the same row and keep the containers connected in pairs by means of middle strip 20 having width "d" and also at a point coincident with their bottom zone. In this way, once the container is filled with a liquid or powder, a deformation of the bottom occurs, forming a bellows 11 which permits the container to be vertically self-supporting.

Figure 4:
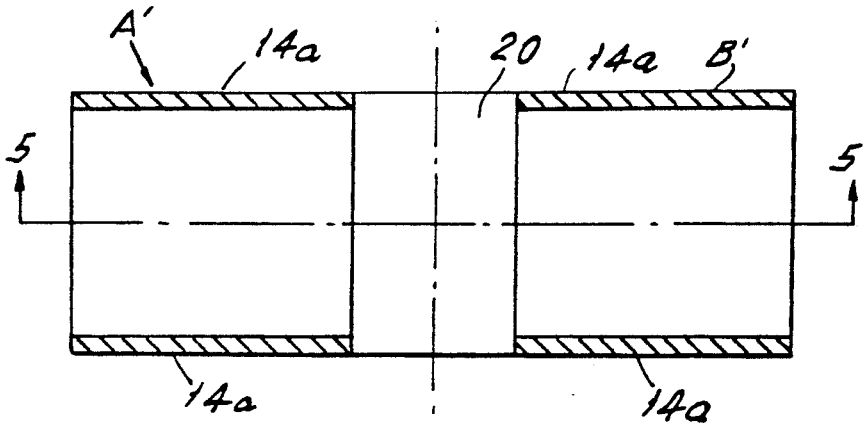
FIG. 4 shows a pair of containers without bottom bellows.
Figure 5:
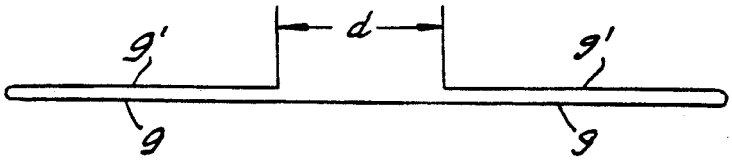
FIG. 5 is a cross-sectional view along lines V—V of the container pair shown in FIG. 4.

Another simplified embodiment of the container pairs without the bellowed bottoms but still within the inventive scope described above, is illustrated in FIGS. 4 and 5. This embodiment is respectively similar to FIGS. 1 and 2, and relates to a package in which only one folded band 9 of heat sealable material is subjected to lateral heat sealing 14*a*, to obtain a very economical pairs of containers A' and B' interconnected by a central strip 20 of width "d", similar to the pairs of containers shown in FIGS. 1 and 2.

Figure 7:
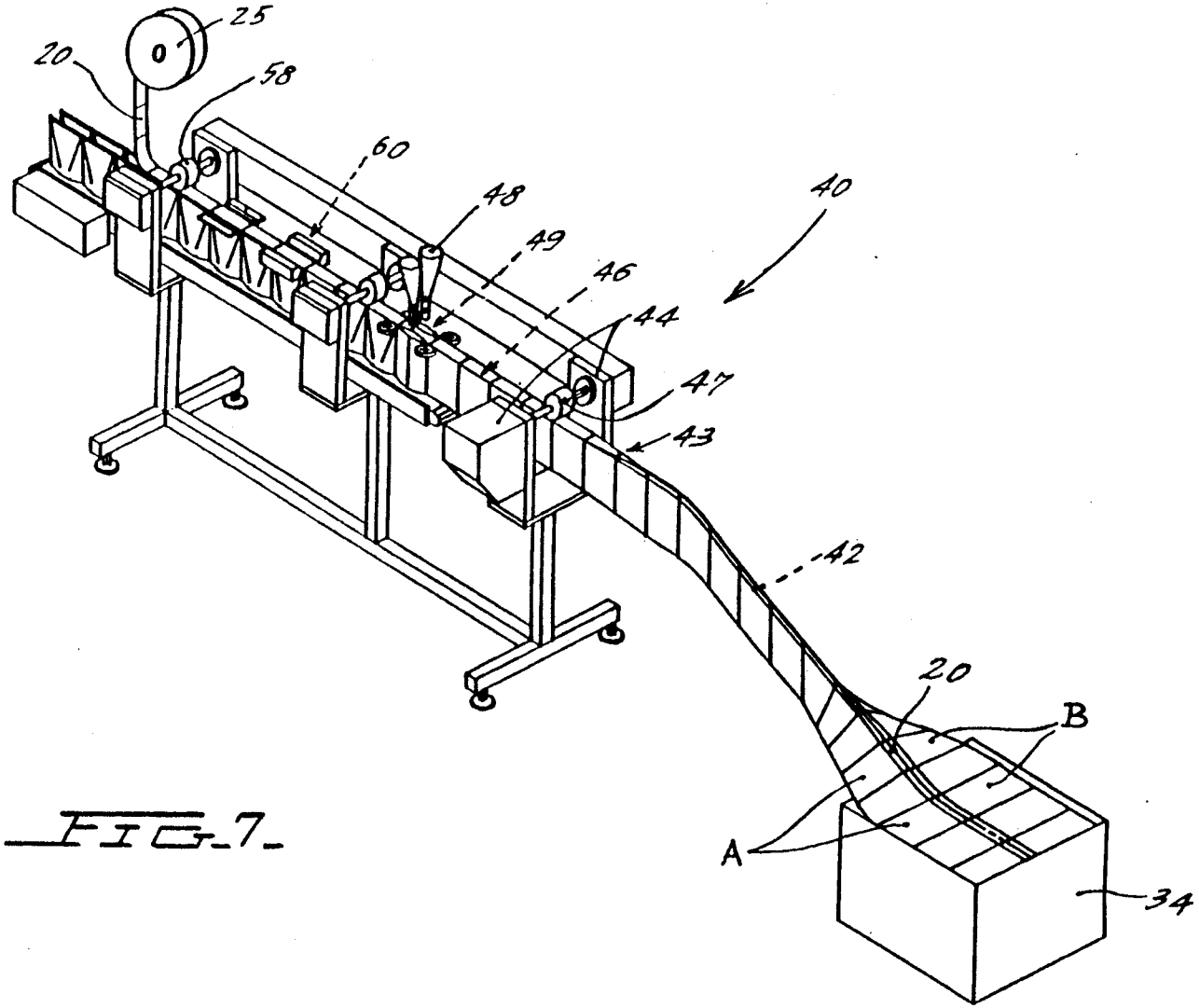
FIG. 7 is a perspective view of the unwinding, filling and sealing equipment for the containers according to the invention.

In FIG. 6, a continuous band 30 of the pairs of containers has the center strip 20 which is identified by printed notches 24 or perforated on its center line with pin holes 22, after which the band 30 is wound on a spool or folded concertina wise into boxes 34 to be supplied to the packaging companies for filling of the bags by the unwinding, filling and sealing facility identified altogether by 40 in FIG. 7.

The facility is equipped upstream with a support 42 inclined toward box 34 and centered with strip 20 which connects the pairs of containers A and B to be folded in the box itself. Proceeding toward the filling and sealing stations, the containers A and B set themselves astride the support 42 which further on at position 43 progressively become narrower, until when coinciding with drawing assembly 44. The containers form a track 46 having transversal width "d" having practically the same width as strip 20 (see FIGS. 8 and 9).

A driving pinion 47 is provided in drawing assemble 44. The pinion has teeth which engage holes 22 in strip 20, so as to achieve a regular positive advancement of packages A and B toward the filling station 48, with the edges of their respective apertures 2 and 4 divaricating.

Alternatively, the advancement of the band of containers can be governed by a photocell (not shown) also able to detect the notches 24 stamped on strip 20 at suitable distances from each other. In order to obtain an adequate and reliable opening of apertures 2 and 4 of the bags (see FIGS. 8 and 9) a device 49 representing a gradual marked reduction of width "d" of track 46 is provided. Device 49 viewed from the top, has an x configuration at filling station 48, with curved side walls 50, 51 along a tract M equal to the chord of a width L of a container in the unfolded status.

Within the tract M, the arched walls 50, 51 show a raised back 52 so that the deformation impressed by the raised back on the strip 20 connecting the opposite pairs of containers A and B, forces the walls 6 and 7 of the single containers to adhere to arched surfaces 50 and 51 whilst the corresponding outer walls curve outwardly in the opposite direction to cause a suitable divarication of the edges of apertures 2 and 4 in a position coinciding with the outlets of filling station 48. The adherence of walls 6 and 7 of the containers to arched walls 50, 51 of track 46, can be aided by suitable guide elements. Other suitable means such as suction systems may be provided to achieve the same purpose. The drawing of the band of packages 30 can be aided by another pinion gear 58 located downstream of heat-sealing station 60 which performs hermetic sealing of apertures 2 and 4 of the containers A cutting assembly 61, further downstream separates the union strip 20 which is then collected as recyclable material, on a small motor driven spool 65 whilst the filled and detached bags drop into respective packing boxes.

If the containers are of the type shown in FIGS. 1,2,3, i.e. of a type provided with a bottom bellows, the weight of the liquid product introduced in each container will automatically divaricate the external walls causing the bag to remain in an upright position, suitable for display on shop shelves in a vertically stable position.

It is obvious that with minimum changes in the filling and sealing stations, the plant may be converted from a step by step type to a continuous type.

What is claimed is:

1. A method for producing a plurality of pairs of containers from a flexible material, comprising the steps of:

unwinding a continuous band of the flexible material, the band having two lateral edges and two opposed surfaces, one of the surfaces being a heat-sealable material;

folding over the lateral edges of the band along respective fold lines to form a folded band having two folded portions, the folded portions each having a transversal width extending between the respective folded over lateral edges and respective outer edges defined by the respective fold liens, the transversal width being equal to at least a height of an individual container to be produced, the surface of heat-sealable material forming an internal surface of each of the folded portions;

maintaining a center strip of the flexible material between the folded over lateral edges of the two folded portions;

forming a series of heat seals transversely along both folded portions at longitudinal intervals, each of the longitudinal intervals being equal to a width of the individual container to be produced, the heat seals forming lateral closing ribs between adjacent pairs of containers and extending from the outer edges of each of the folded portions toward the center strip and terminating a short distance before the folded over lateral edges;

cutting the folded band transversely along a midline of the heat seals, without cutting the center strip;

detaching adjacent containers from each other along the cut mid-line, wherein each of the plurality of pairs of containers remain connected along the center strip and at a point adjacent to the outer edges of the folded portions; and collecting the plurality of detached pairs of containers.

2. The method of claim 1, wherein the step of collecting comprises winding the band of the plurality of detached pairs of containers on a spool.

3. The method of claim 1, wherein the step of collecting comprises folding the plurality of the bands of the detached pairs of containers in an accordion manner into a packing box.

4. The method of claim 1, wherein the band forms two parallel rows of containers separated by the center strip.

5. The method of claim 1, wherein the folded over lateral edges form apertures for the containers along the center strip between the heat seals, the containers of each pair being symmetrically opposed across the center strip.

6. The method of claim 1, wherein the other surface of the band is a non-heat sealable material.

7. The method of claim 1, wherein each of the containers has a bellowed bottom and the band of the material originally has a width equal to four times the height of the container plus the width of the center strip plus the height of the bellowed bottom of the container.

8. The method of claim 1, further comprising the step of providing a plurality of perforations or notches along the center strip.

9. A method for filling and sealing a plurality of pairs of containers, comprising the steps of:

feeding a band of the plurality of pairs of containers along a support, the band forming two parallel rows of containers separated by a center strip;

centering the center strip of the band of the plurality of paris of containers along the support, the containers being vertically suspended form either side of the support with apertures of the containers facing upward;

divaricating edges of the apertures of the containers to open the apertures;

filling the containers at a filling station;

heat sealing the apertures of the containers;

separating the center strip from the parallel rows of containers;

recovering the separated strip; and collecting the filled and sealed containers.

10. An apparatus for filling and sealing a plurality of pairs of containers comprising:

feeding means for delivering a band of the plurality of pairs of containers, the band forming two parallel rows of containers separated by a center strip;

a stationary support upstream of the feeding means, the center strip of the band resting on the support with the rows of containers being vertically suspended from the support, each of the containers having an aperture which faces upward;

divaricating means disposed downstream of the feeding means for opening the apertures;

filling means approximately coinciding with the divaricating mans for filling the containers with a product, wherein the support extends through the feeding and divaricating means and widens near the filling means to form a flat support;

sealing means for heat sealing the apertures of the containers downstream of the filling means;

cutting means downstream of the sealing means for separating the center strip from the containers;

means for recovering the separated center strip; and means for collecting the filled and sealed containers.

11. The apparatus of claim 10, wherein the flat support has a width substantially equal to a width of the center strip, so that the center strip rests completely flat on the support.

12. The apparatus of claim 11, wherein the divaricating means is formed by a section of the flat support which is progressively reduced and widened to provide two arched walls, symmetrically concave and facing outwardly.

13. The apparatus of claim 12, wherein the section of the flat support having the arched walls includes a raised back facing upwardly which forces a wall of the containers to adhere to one of the arched walls to widen the respective aperture.

14. The apparatus of claim 10, wherein the center strip includes a plurality of perforations, the feeding means comprising a pinion having teeth which engage said perforations to drawn the band toward the filling means.

15. The apparatus of claim 10, wherein the recovery means comprises a motor driven spool upon which the separated center strip is wound.

* * * * *